US008291673B2

(12) United States Patent
Straight, Jr.

(10) Patent No.: US 8,291,673 B2
(45) Date of Patent: Oct. 23, 2012

(54) DUST CONTROL COVER FOR CHANNEL

(75) Inventor: Robert L. Straight, Jr., Knoxville, TN (US)

(73) Assignee: Straight Holdings, LLC, Knoxville, TN (US)

( * ) Notice: Subject to any disclaimer, the term of this patent is extended or adjusted under 35 U.S.C. 154(b) by 95 days.

(21) Appl. No.: 12/898,033

(22) Filed: Oct. 5, 2010

(65) Prior Publication Data

US 2012/0017532 A1 Jan. 26, 2012

(51) Int. Cl.
*E04C 2/38* (2006.01)

(52) U.S. Cl. ..... 52/718.01; 52/DIG. 4; 52/839

(58) Field of Classification Search ..... 52/DIG. 4, 52/101, 220.1, 220.7, 650.1, 718.01, 839, 52/843; 403/DIG. 1
See application file for complete search history.

(56) References Cited

U.S. PATENT DOCUMENTS 1,173,626 A 8/1930 Larkin
3,982,370 A * 9/1976 Buffington ..... 52/481.2
3,986,312 A * 10/1976 Calhoun et al. ..... 52/242
4,159,604 A 7/1979 Burrell
4,709,522 A * 12/1987 Carnahan ..... 52/288.1
4,800,696 A 1/1989 Miller et al.
5,195,248 A * 3/1993 Juhasz ..... 33/393
5,313,754 A * 5/1994 Jensen ..... 52/255
5,487,199 A * 1/1996 Nelson ..... 14/74.5
5,913,780 A * 6/1999 Goergen ..... 52/101
6,575,395 B2 * 6/2003 Rodriguez ..... 242/526.2
6,959,520 B2 11/2005 Hartman
2002/0157851 A1 10/2002 Compagnone
2008/0112756 A1 5/2008 Omar

* cited by examiner

*Primary Examiner* — Brian Glessner
*Assistant Examiner* — Brian D Mattei
(74) *Attorney, Agent, or Firm* — Smith, Gambrell & Russell

(57) ABSTRACT

A novel dust cover is formed to overlie horizontal structural surfaces such as a channel or web of an I-beam, H-beam, conduit or channel member. The dust cover includes an elongated spanning section and a pair of longitudinal leg members extending from the spanning section to lie flush against the adjacent structural element to prevent dust accumulation. The cover is held to the structural member by a plurality of magnets spaced along the length of the member.

11 Claims, 3 Drawing Sheets

DUST CONTROL COVER FOR CHANNEL

BACKGROUND OF THE INVENTION

The present invention relates to the field of combustible dust control and more particularly industrial dust control. According to OSHA combustible dusts are often either organic or metal dusts that are finely ground into very small particles, fibers, fines, chips, chunks, flakes, or a small mixture of these. Types of dusts include, but are not limited to: metal dust, such as aluminum and magnesium; wood dust; plastic dust; bio-solids; organic dust, such as sugar, paper, soap, and dried blood; and dusts from certain textiles. Some industries that handle combustible dusts include: agriculture, chemicals, textiles, forest and furniture products, wastewater treatment, metal processing, paper products, pharmaceuticals, and recycling operations (metal, paper, and plastic).

National Fire Prevention Association section 654 contains guidance on combustible dust layer characterization and precautions. It indicates that immediate cleaning is warranted whenever a dust layer of 1/32-inch thickness accumulates over a surface area of at least 5% of the floor area of the facility or any given room. Accumulations on overhead beams, joists, ducts, the tops of equipment, and other surfaces should be included when determining the dust coverage area. Even vertical surfaces should be included if the dust is adhering to them. Rough calculations show that the available surface area of bar joists is approximately 5% of the floor area and the equivalent surface area for steel beams can be as high as 10%

SUMMARY OF THE PRESENT INVENTION

It is an object of the present invention to retard the accumulation of dust on structural members such as I-beams, channel members and conduits. It is a further object of the invention to reduce combustible dust accumulation in a manner that provides surfaces that are easily cleaned and inspected. These objects are met in a novel dust cover which is formed and overlies the dust accumulating horizontal surfaces of a channel or web of an I beam, H-beam, channel member or conduit. The dust reduction system includes one or more dust covers which have a surface oriented such that gravity prevents dust from accumulating thereon. The cover is held to the structural member by a plurality of magnets spaced along the length of the member.

These and other objects and advantages of the invention will become apparent from the following detailed description of the preferred embodiment of the invention.

BRIEF DESCRIPTION OF THE DRAWINGS

A cover for controlling combustible dust accumulation is depicted in the accompanying drawings which form a portion of this disclosure and wherein.

DESCRIPTION OF THE PREFERRED EMBODIMENT

Referring to the FIGS. 1-6 for a clearer understanding of the invention, it may be seen that the preferred embodiment of the invention contemplates a removable dust cover which completely overlies and substantially seals a horizontal surface as might be formed in the channel formed by the web and flanges of a structural beam or a conduit. The dust cover is held in place by a combination of magnets and the engagement of the cover with surface.

Figure 1:
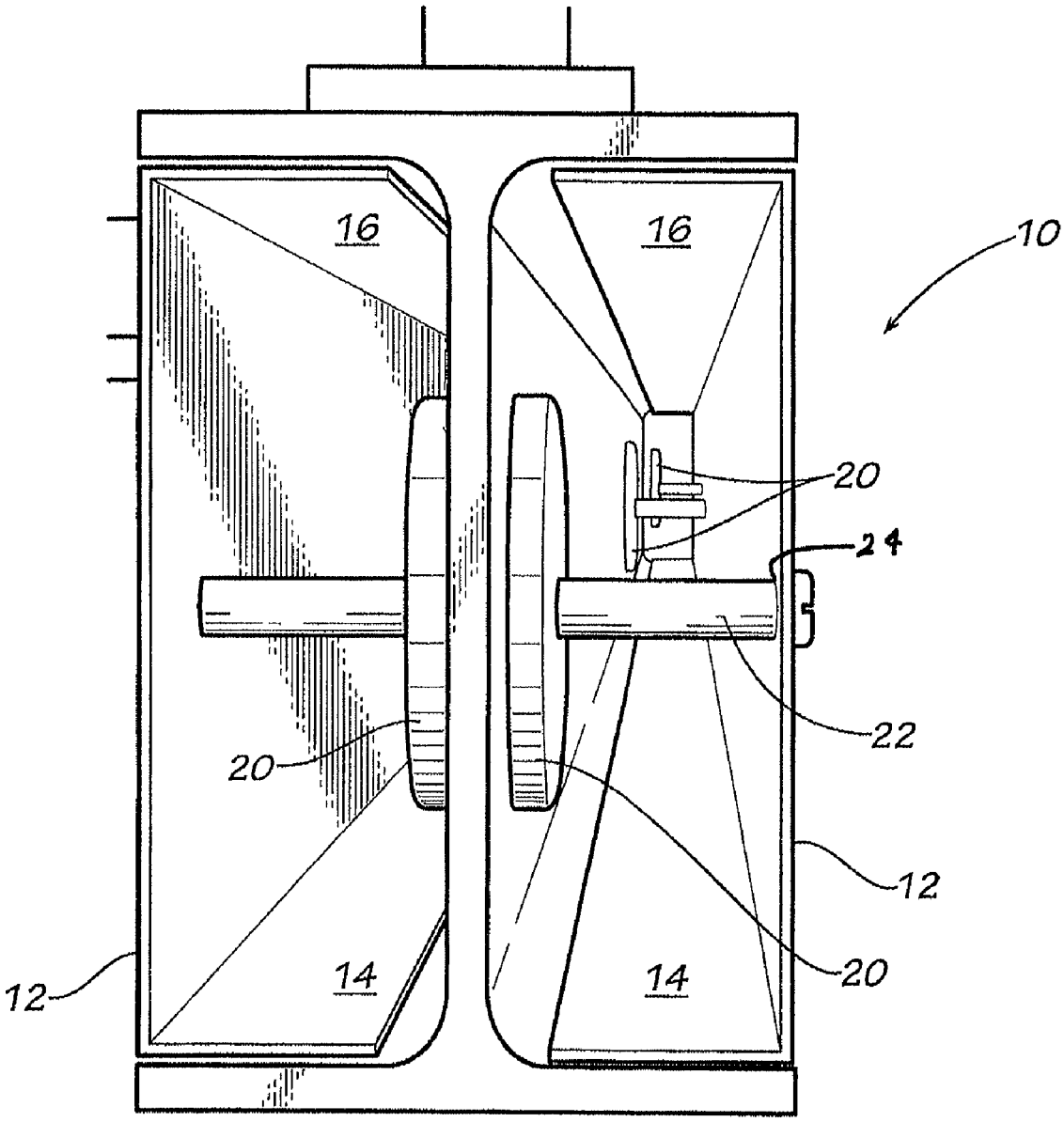
FIG. 1 is an end view of an I-beam with an embodiment of the invention installed in each channel of the I-beam.

In the embodiment shown in FIG. 1, it may be seen that cover 10 includes a longitudinally extending spanning section 12 and a pair of longitudinally extending leg members 14 and 16 extending from spanning section 12 toward the opening of the channel. The width of spanning section 12 is dependant on the size of the structural member, however, leg members 14 and 16 would rarely need to exceed one and one half inches in length. Leg members 14 and 16 may fit snugly within the channel or may engage the outside of the structural flanges forming the channel with the intent being that the cover substantially prevents accumulation on the surface of the flanges forming the channel. Cover 10 is preferably made from aluminum with an acceptable range of material thickness of about 0.032 to 0.050 with a medium (5) temper.

Cover 10 is held to the structural member by a plurality of magnets 20 spaced along the length of the member. The temper of the aluminum cover 10 gives the material lateral strength yet allows the legs 12 and 14 to be formed by bending the material along the lateral margin of the spanning section. Aluminum is preferred because it is easy to work, is light weight, is relatively low in cost, is non-flammable, will not retain moisture or attact or entrap dust. Another suitable material for this application is UHMW which is often used in industrial applications, and has basically the same properties as aluminum as to water and dust absorption. UHMW is somewhat heavier and more expensive than aluminum and would require reinforcing backing or much greater thickness to give it lateral integrity. Further a UHMW cover would be more likely to melt or burn. Other materials may be used for cover 12, however each would have some trade off in terms of weight, cost, moisture and dust retention.

The magnets 20 are attached to cover 10 by bolts 22 extending through a plurality of apertures 24 spaced longitudinally along spanning section 12. Acceptable spacing would be at about 4 feet. Bolts 22 are secured to magnets 2 by an affixed barrel nut or thread formed in the magnet. Although preliminary indications are that magnets 20 should each be rated with a minimum 10 pound pull force which is the force required to pull a magnet free from a flat steel plate using force perpendicular to the surface, it should be understood that the specific strength of the magnet is dependent on the weight of the cover and the conditions of the beams to which they are attached. Magnets 20 will be required to reliably secure the cover 10 to the steel beams, as it is anticipated that these covers will be washed down with either high pressure water or air. The magnet will secure the aluminum to steel that has been primed and painted with various mils of paint. The amount of paint and primer will vary based on plant specifications, age, wear and tear. Further, it is to be understood that the covers will have to be periodically removed to insure that there is minimal dust retention in the cavity between the cover and the structural member and for routine inspection of the structural members, thus, the aluminum cover has to be secure yet removable. An acceptable range of pull force per magnet to meet these requirements is 10-20 lbs per linear foot.

Figure 6:
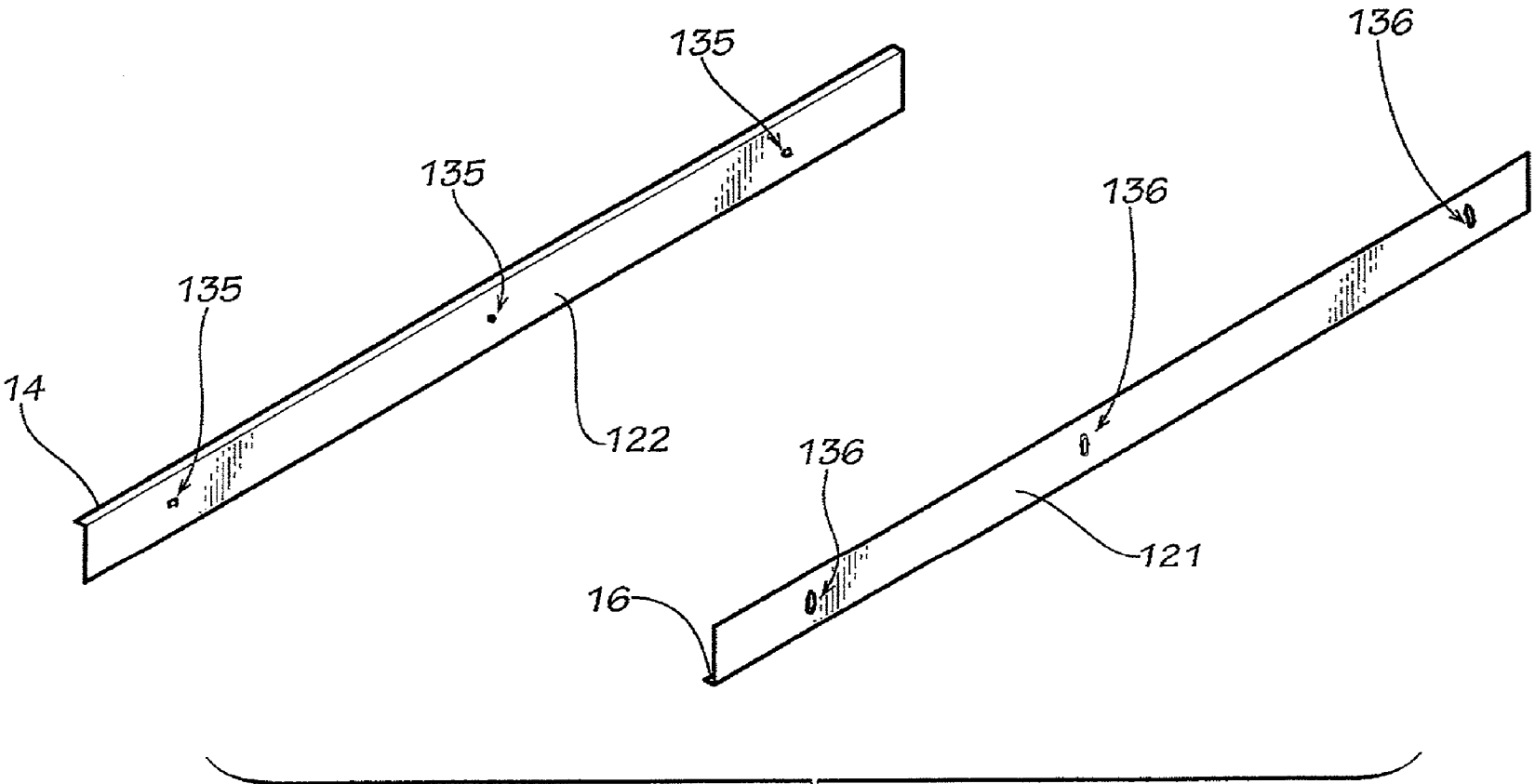
FIG. 6 is perspective expanded view of components of the first embodiment of the invention.

Referring to FIG. 6, it can be seen that the cover 10 may be made adjustable by forming the spanning section 12 from two mating segments 121 and 122 with each segment associated with one of the leg members 14 or 16. Segment 121 includes a plurality of slots 136 extending transversely of its length. Segment 122 includes a plurality of complementary apertures 135 aligned with slots 136 such that bolts 22 and preferably additional fasteners can engage the aligned slots and apertures to adjustably connect segment 121 and 122, thus enabling the cover to vary in width to accommodate variations in the width of I-beam channels.

Figure 2:
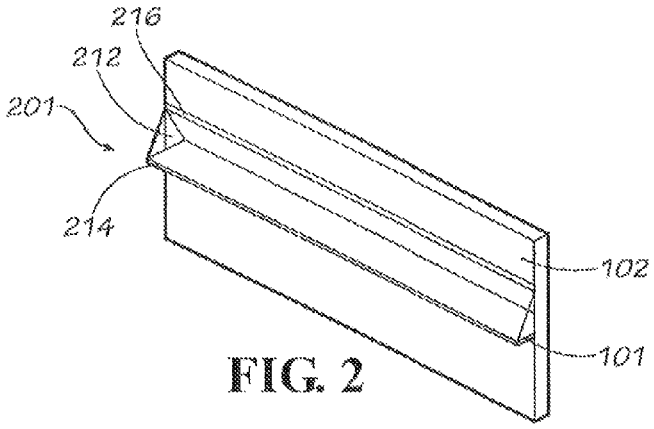
FIG. 2 is a perspective view of a second embodiment of the invention installed above an I-beam adjacent a bulkhead.

Another embodiment of the cover is shown in FIG. 2. This embodiment is used to protect a beam 101 reinforcing a bulkhead 102 which provides a horizontal surface on which combustible dust may accumulate. Cover 201 includes a central span 212 and longitudinal flanges 214 and 216. Magnets 20 are attached to the central span 212 by connector bolts 22 in the same manner as in the previously described embodiment. It will be seen that flange 216 extends upwardly against bulkhead 102 and is flush with the surface of the bulkhead to prevent dust from passing behind cover 201. Cover 201 overlies the horizontal surface formed by beam 101, with flange 214 resting against the beam 101 to prevent dust accumulation.

Figure 3:
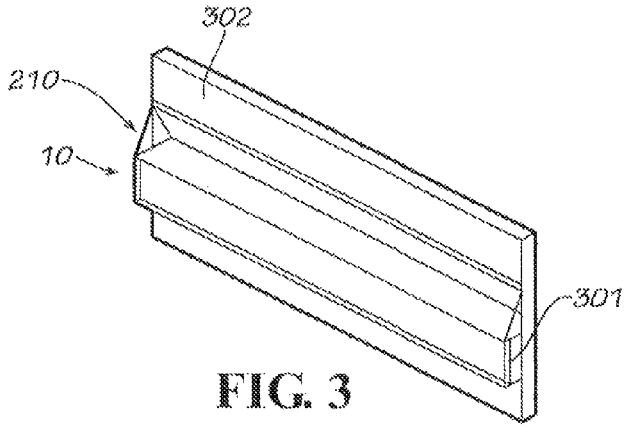
FIG. 3 is a perspective view of the second embodiment of the invention installed above a gusset at a bulkhead.

Referring to FIG. 3, the embodiments shown in FIGS. 1 and 2 are combined to eliminate dust on a vertically oriented beam 301 adjacent a wall or bulkhead 302. Cover 10 is attached using magnets 320 and bolts 322 to protect the laterally opening channel of beam 301, while cover 210 overlies the top flange of beam 301 to prevent dust accumulation thereon.

Figure 4:
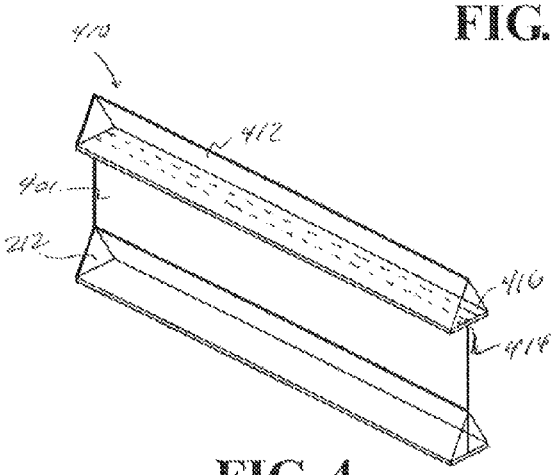
FIG. 4 is a perspective view of a third embodiment of the invention spanning the upper flange of an I-beam and a second embodiment covering the lower flanges of the I-beam.

FIG. 4 shows an embodiment wherein an I-beam 401 has a web tall enough that it is more practical to cover the upper flange and the upper portion of the lower flange separately. Accordingly, the embodiment shown in FIG. 2 can be used to overlie the lower flange surfaces or can be modified such that flange 214 can rest atop the lower flange surfaces. A fourth embodiment of the cover 410 is used to overlie the exposed top surface of the upper flange. In this embodiment the central span 412 is peaked along a longitudinal line and two inclined opposing sides slope downwardly from the apex of the peak to in-turned flanges 414 and 416 which rest atop the I-beam 401. Magnets 420 and bolts 422 are used to hold cover 410 in place as with the other embodiments.

Figure 5:
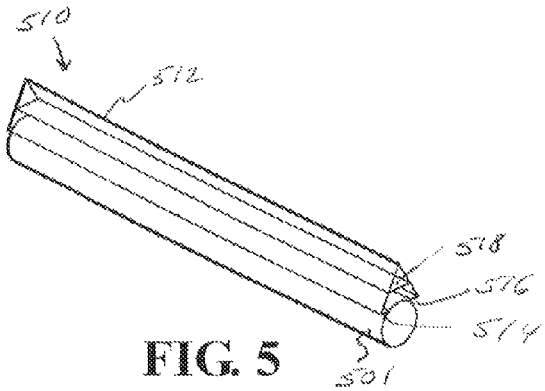
FIG. 5 is a perspective view of a fourth embodiment of the invention covering a conduit.

Referring to FIG. 5, a modification 510 of the embodiment shown in FIG. 4 can be utilized to overlie a conduit 501. Central span 512 is peaked along a longitudinal line and two inclined opposing sides slope downwardly from the apex of the peak to in-turned flanges 514 and 516 which abut conduit 501 along a horizontal cord draw through the upper half of the conduit. A horizontal support plate 518 is affixed between the opposing sided and engages bolts 522 which connect magnets 520 to cover 510.

It is to be understood that the form of the invention shown is a preferred embodiment thereof and that various changes and modifications may be made therein without departing from the spirit of the invention or scope as defined in the following claims.

What is claimed is:

1. A dust control system for reducing the accumulation of combustible dust on substantially horizontal surfaces formed on ferromagnetic structures comprising:

a. a cover having an outer surface inclined at an angle relative to said substantially horizontal surfaces such that gravity prevents the accumulation of dust thereon, said cover overlying said substantially horizontal surfaces, and b. at least one magnet connected to said cover and displaced there from to engage said ferromagnetic structures and of sufficient magnetic strength to hold said cover in place while overlying said substantially horizontal surfaces wherein said magnet is connected to and displaced from said cover by a connector having a threaded shaft for engagement with a threaded receptacle on said magnet.

2. A dust control system as described in claim 1 wherein said cover is made from a non-ferrous material.

3. A dust control system as described in claim 2 wherein said cover is adapted to overlie a top flange of a beam.

4. A dust control system as described in claim 2 wherein said cover is adapted to overlie a pipe.

5. A dust control system as described in claim 1 wherein the outer surface of said cover defines an elongated peak having by opposed sides sloping downwardly from an apex and engaging a top portion of said substantially horizontal surface.

6. A dust control system as described in claim 1 wherein said magnet requires a pull force of at least ten pounds to separate it from said ferromagnetic structure.

7. A dust control system as described in claim 1 wherein said cover comprises a first vertical portion superjacent and co-linear with said outer surface.

8. A dust control system for reducing the accumulation of combustible dust on substantially horizontal surfaces formed on ferromagnetic structures comprising:

a. a cover having an outer surface inclined at an angle relative to said substantially horizontal surfaces such that gravity prevents the accumulation of dust thereon, said cover overlying said substantially horizontal surfaces, and b. at least one magnet connected to said cover and displaced there from to engage said ferromagnetic structures and of sufficient magnetic strength to hold said cover in place while overlying said substantially horizontal surfaces wherein said cover is adapted for overlying the horizontal surfaces formed on a channel flange of a beam comprising a channel cover including a central elongated region, a pair of elongated legs integrally formed along longitudinal margins of the central elongated region for engagement with a channel formed by said beam, and wherein said at least one magnet is attached to said central region by a connector such that the magnet and cover can be seated within the channel and magnetically held to said beam.

9. A dust control system as described in claim 8 wherein central elongated region includes a first panel extending from one of said pair of legs and a second panel extending from another of said pair of legs in overlapping relationship to said first panel such that said central elongated region may be adjusted to conform to said channel.

10. A dust control system as described in claim 9 wherein said first and second panel are connected by an adjustable fastener such that said panels may be configured to span beams having different widths and secured to each other.

11. A cover as described in claim 8 wherein said pair of elongated legs extend within said channel and resiliently engage said channel.

* * * * *